US007557288B2

(12) United States Patent
Akazawa et al.

(10) Patent No.: US 7,557,288 B2
(45) Date of Patent: Jul. 7, 2009

(54) TONE SYNTHESIS APPARATUS AND METHOD

(75) Inventors: Eiji Akazawa, Hamamatsu (JP); Yasuyuki Umeyama, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 157 days.

(21) Appl. No.: 11/651,699

(22) Filed: Jan. 9, 2007

(65) Prior Publication Data

US 2007/0157796 A1 Jul. 12, 2007

(30) Foreign Application Priority Data

Jan. 10, 2006 (JP) ..... 2006-001984

(51) Int. Cl.
*G10H 7/00* (2006.01)

(52) U.S. Cl. ..... 84/604; 84/609; 84/625; 84/627

(58) Field of Classification Search ..... 84/604, 84/609, 625, 627
See application file for complete search history.

(56) References Cited

U.S. PATENT DOCUMENTS 5,610,353 A * 3/1997 Hagino ..... 84/604
6,255,576 B1 * 7/2001 Suzuki et al. ..... 84/604
6,316,710 B1 * 11/2001 Lindemann ..... 84/609
2002/0134222 A1 9/2002 Tamura
2002/0143545 A1 * 10/2002 Tamura et al. ..... 704/266
2002/0178006 A1 * 11/2002 Suzuki et al. ..... 704/258
2006/0272482 A1 * 12/2006 Tamura et al. ..... 84/604

FOREIGN PATENT DOCUMENTS

EP 0 907 160 A1 4/1999

* cited by examiner

*Primary Examiner*—Jeffrey Donels
*Assistant Examiner*—Christina Russell
(74) *Attorney, Agent, or Firm*—Morrison & Foerster LLP

(57) ABSTRACT

In a storage section, there are stored special connecting waveform data for connecting between at least two notes to be generated in succession. The special connecting waveform data contain only a waveform of a succeeding-note region of a waveform connecting portion which is provided for a continuous transition between the at least two notes and which is divided into a preceding-note region and the succeeding-note region. When a connecting tone is to be generated for connecting between two notes in accordance with acquired performance information, a tone waveform connecting between waveforms of the two notes is generated using the special connecting waveform data. With such arrangements, the waveform data of the succeeding-note region are read out without waveform data of the preceding-note region being read out, so that it is possible to reduce a time required for transition from a preceding note to a succeeding note. Thus, in the connecting portion for continuously connecting between tones with no break therebetween, a tone can be synthesized with high quality without involving a tone generating delay in the succeeding note.

7 Claims, 5 Drawing Sheets

TONE SYNTHESIS APPARATUS AND METHOD

BACKGROUND OF THE INVENTION

The present invention relates generally to tone synthesis apparatus and methods for synthesizing tones, voices or other desired sounds on the basis of waveform sample data stored in a waveform memory or the like, and programs therefore. More particularly, the present invention relates to an improved tone synthesis apparatus and method for performing tone synthesis in a note connecting (or waveform connecting) portion, provided for continuously connecting between adjoining or successive tones or notes with no discontinuity or break therebetween, without involving an auditory tone generating delay.

Heretofore, the so-called AEM (Articulation Element Modeling) technique has been known as a technique for facilitating realistic reproduction and reproduction control of various rendition styles (various types of articulation) peculiar to natural musical instruments. As known in the art, the AEM technique can generate a continuous tone waveform with high quality by time-serially combining a plurality of ones of rendition style modules corresponding to various portions of tones, such as attack rendition style modules each representative of a rise (i.e., attack) portion of a tone, body rendition style modules each representative of a steady portion (or body portion) of a tone, release style modules each representative of a fall (i.e., release) portion and joint rendition style modules each representative of a note (or waveform) connecting portion (or joint portion) for continuously connecting between successive notes with no break therebetween using a desired rendition style like a legato rendition style. Note that, throughout this specification, the terms "tone waveform" are used to mean a waveform of a voice or any desired sound rather than being limited only to a waveform of a musical tone. One of various examples of inventions pertaining to such an AEM technique is disclosed in U. S. patent application publication No. 2002-0143545 corresponding to Japanese Patent Application Laid-open Publication No. 2002-287759.

FIG. 8 shows an example of a continuous tone waveform connecting between successive notes, with no break therebetween, using a conventionally-known joint rendition style module. As shown in (a) of FIG. 8, when note-on information of a succeeding one of successive notes has been acquired, as performance information (e.g., MIDI information), prior to acquisition of note-off information of a preceding one of the notes, a continuous tone waveform connecting between successive notes, with no break therebetween, using a desired rendition style is provided by representing the preceding note (i.e., tone to be generated first) with an attack rendition style module and body rendition style module, representing the succeeding note (i.e., tone to be generated following the preceding note) with a body rendition style module and release rendition style module and further interconnecting the respective body rendition style modules with a joint rendition style module. Further, in forming a continuous tone waveform by time-serially combining a plurality of rendition style modules, the AEM technique uses crossfade synthesis or crossfade connection for interconnecting rendition style modules in a crossfading manner without involving unnaturalness of a tone. Thus, in this case too, a body rendition style module and joint rendition style module of a preceding note, another joint rendition style module and body rendition style module of a succeeding note are connected together in a crossfade fashion (i.e., "crossfade-connected") using loop waveforms L1, L2, L3 and L4 (indicated by vertically-elongated rectangular blocks) adjoining the respective joint rendition style modules.

To facilitate clear understanding, a non-loop waveform of a first half section of a conventionally-known joint rendition style module, corresponding to a region of the module where a tone pitch of a preceding (or first) tone, is mainly heard or auditorily perceived as compared to a tone pitch of a succeeding (or second) tone will be referred in this specification to as "preceding-note region" (indicated in the figure by a hatched section PR), and a non-loop waveform of a second half section of the joint rendition style module, corresponding to a region of the module where the tone pitch of the succeeding note, is mainly heard or auditorily perceived as compared to the tone pitch of the preceding note (more specifically, region following a point where the tone pitch of the preceding note shifts to the tone pitch of the succeeding note) will be referred to as "succeeding-note region". Also, note that the terms "loop waveform" are used to refer to a waveform that is read out in a repetitive (or looped) fashion.

In a case where a tone is synthesized using a joint rendition style module, there may sometimes be caused an auditory tone generating delay before a succeeding one of successive notes starts to be heard; such an auditory tone generating delay will hereinafter referred to also as "latency". As seen in (a) of FIG. 8, tone synthesis based on a joint rendition style module is started after receipt of note-on information of a succeeding one of successive notes in question. Further, with the joint rendition style module, the human can not auditorily perceive that sounding of the succeeding note has started (i.e., that there has occurred a shift from the tone pitch of the preceding note to the tone pitch of the succeeding note) before tone synthesis timing shifts from the preceding-note region to the succeeding-note region. Therefore, if the preceding-note region of the joint rendition style module has a relatively long time length (see the hatched section PR in (b) of FIG. 8), it would be a long time before synthesis of a tone of the succeeding-note region is started after start of synthesis of a tone of the preceding-note region, so that a human player etc. may feel a tone generating delay (latency) of the succeeding-note region. Particularly, the time length of the preceding-note region of the joint rendition style module depends on the tone pitch of the preceding note; that is, if the preceding note has a high tone pitch, the preceding-note region would have a shorter time length, while, if the preceding note has a low tone pitch, the preceding-note region would have a longer time length. Further, depending on the type of a musical instrument in question, it is necessary to set the preceding-note region to a rather long time length in view of a possible influence of the tone pitch shift or transition (e.g., where the musical instrument is a trombone). Therefore, a low pitch tone tends to cause a latency more notably than a high pitch tone, and, depending on the type of the musical instrument, such a latency tends to be always felt. Thus, it has been conventional to acquire (or pre-read) performance information (e.g., MIDI information) of a succeeding note prior to arrival of predetermined performance timing, so as to synthesize a tone by allotting a joint rendition style module to an appropriate time position in consideration of a time length of a preceding-note region based on the pre-read performance information of the succeeding note (so-called "playback performance"). In such a playback performance, a latency resulting from the use of a joint rendition style module seldom becomes a problem because time adjustments are made as noted above.

However, in a real-time performance where tones are sequentially synthesized in response to actual performance operation by a human player, a latency in a connecting portion between tones or notes would become a problem. Namely, in a real-time performance, unlike in the aforementioned playback performance, performance information, such as note-on information and note-off information, corresponding to actual performance operation can of course not be acquired prior to the actual performance operation, and the performance information is supplied in real time in response to actual performance operation. Therefore, a succeeding one of successive notes is inevitably influenced by the time length of the preceding-note region of a joint rendition style module used, so that a latency would be undesirably produced for the succeeding note in a connecting portion between the notes or tones.

SUMMARY OF THE INVENTION

In view of the foregoing, it is an object of the present invention to provide a tone synthesis apparatus and method which can synthesize high-quality tones, faithfully representing variation in tone color, without involving an undesired auditory tone generating delay, in a connecting (or joint) portion, between notes or tones.

In order to accomplish the above-mentioned object, the present invention provides an improved tone synthesis apparatus, which comprises: a storage section that stores special connecting waveform data for connecting between at least two notes to be generated in succession, the special connecting waveform data containing only a waveform of a succeeding-note region of a waveform connecting portion which is provided for a continuous transition between the at least two notes and which is divided into a preceding-note region and the succeeding-note region; an acquisition section that acquires performance information in accordance with a progression of a performance; and a tone generation section that, when a connecting tone is to be generated for connecting between at least two successive notes in accordance with the performance information acquired by the acquisition section, acquires the special connecting waveform data from the storage section and generates a tone waveform connecting between waveforms of the at least two successive notes on the basis of the acquired special connecting waveform data.

According to the present invention, when a connecting tone is to be generated for connecting between at least two successive notes (or tones) in accordance with acquired performance information, the special connecting waveform data are acquired from the storage section, and a tone waveform connecting between waveforms of the at least two successive notes is generated on the basis of the acquired special connecting waveform data. In the present invention, the special connecting waveform data, stored in the storage section, contain only the waveform of the succeeding-note region of the waveform connecting portion which is provided for a continuous transition between the at least two notes and which is divided into the preceding-note region and the succeeding-note region. Namely, because a tone is synthesized using the special connecting waveform data containing only the waveform of the succeeding-tone region (without containing a waveform of the preceding-note region) belonging to the connecting portion. Thus, waveform data of the succeeding-note region are read out directly, without waveform data of the preceding-note region being read out, so that it is possible to reduce a time required for a shift or transition from the preceding note to the succeeding note. Thus, in the connecting portion for continuously connecting between the notes with no break therebetween, a tone, faithfully representing tone color variation by a legato rendition style or the like, can be synthesized with high quality without involving an undesired auditory tone generating delay (or latency) of the succeeding note.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE EMBODIMENTS

Figure 1:
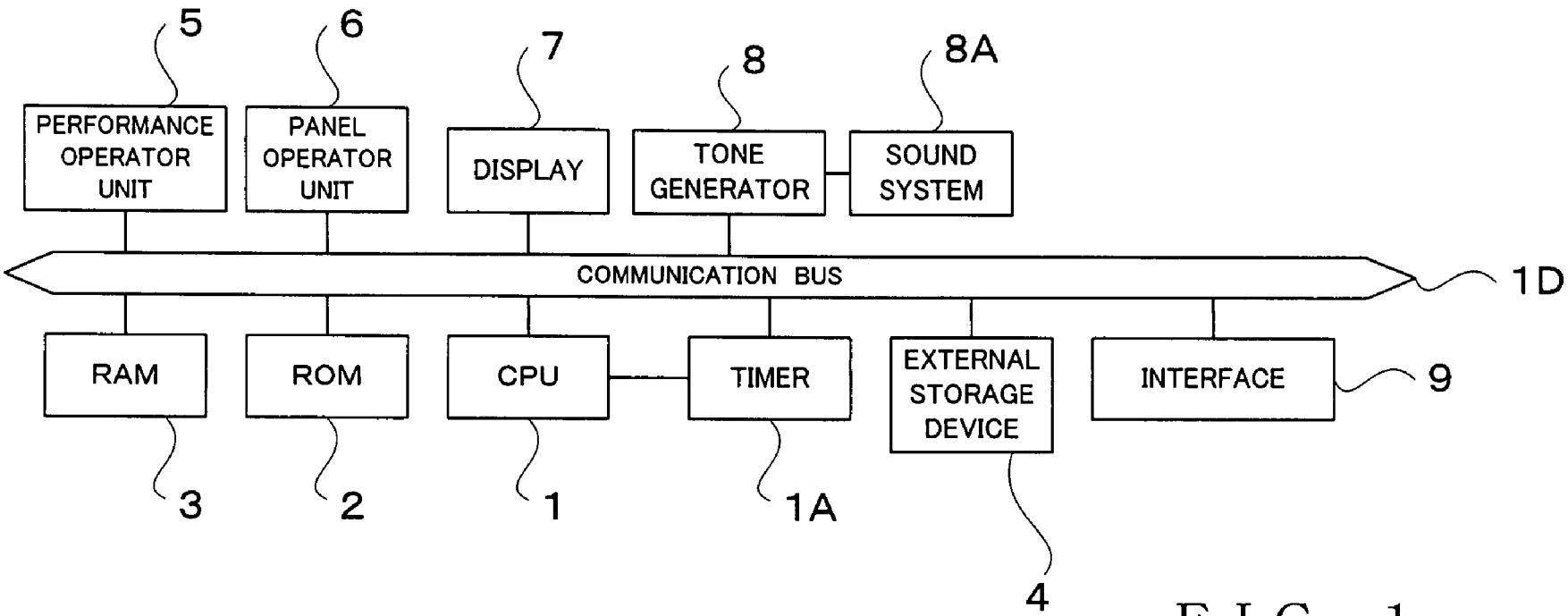
FIG. 1 is a block diagram showing an example general hardware setup of an electronic musical instrument to which is applied a tone synthesis apparatus in accordance with an embodiment of the present invention.

FIG. 1 is a block diagram showing an exemplary general hardware setup of an electronic musical instrument to which is applied a tone synthesis apparatus in accordance with an embodiment of the present invention. The electronic musical instrument illustrated here has a tone synthesis function for electronically generating tones on the basis of performance information (e.g., performance event data, such as note-on information and note-off information, and various control data, such as dynamics information and pitch event information) supplied in real time in response to actual performance operation, by a human player, on a performance operator unit 5, and for automatically generating tones while performing, for example, pre-reading of data based on pre-created performance information sequentially supplied in accordance with a performance progression. Further, during execution of the above-mentioned tone synthesis function, the tone synthesis apparatus selects, for a note (waveform) connecting portion (or joint portion) where two successive notes are continuously interconnected with no break therebetween, waveform sample data (hereinafter simply referred to as "waveform data") to be used on the basis of performance information and parameter information and synthesizes a tone in accordance with the selected waveform data. In the aforementioned manner, the instant embodiment of the invention allows a tone of a legato rendition style or the like to be reproduced with high quality without involving an undesired auditory tone generating delay (latency). Such tone synthesis for the connecting or joint portion will be later described in detail.

Although the electronic musical instrument employing the tone synthesis apparatus to be detailed below may include other hardware than those described here, it will hereinafter be explained in relation to a case where only necessary minimum resources are used. The electronic musical instrument will be described hereinbelow as employing a tone generator that uses a conventionally-known tone waveform control technique called "AEM (Articulation Element Modeling)" (so-called "AEM tone generator"). The AEM technique is intended to perform realistic reproduction and reproduction control of various rendition styles etc. faithfully expressing tone color variation based on various rendition styles or various types of articulation peculiar to various natural musical instruments, by prestoring, as sets of waveform data corresponding to rendition styles peculiar to various musical instruments, entire waveforms corresponding to various rendition styles (hereinafter referred to as "rendition style modules") in partial sections or portions, such as an attack portion, release portion, body portion, etc. of each individual tone or note and then time-serially combining a plurality of the prestored rendition style modules to thereby form a tone of one or more successive notes.

Figure 4:
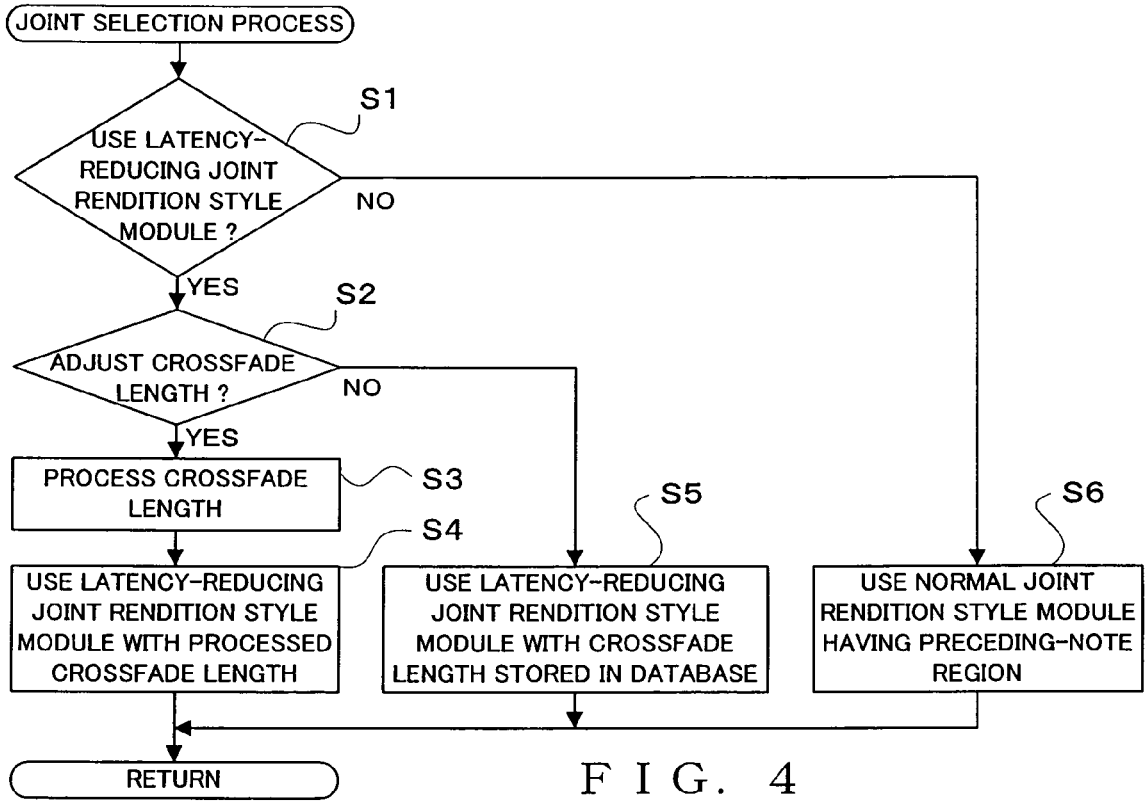
FIG. 4 is a flow chart showing an embodiment of a joint selection process performed in the tone synthesis apparatus.

The electronic musical instrument shown in FIG. 1 is implemented using a computer, where various "tone synthesis processing" (only processing pertaining to a joint rendition style module will be explained later with primary reference to FIG. 4) for realizing the above-mentioned tone synthesis function is carried out by the computer executing respective predetermined programs (software). Of course, these processing may be implemented by microprograms to be executed by a DSP (Digital Signal Processor), rather than by such computer software. Alternatively, the processing may be implemented by a dedicated hardware apparatus having discrete circuits or integrated or large-scale integrated circuit incorporated therein.

In the electronic musical instrument of FIG. 1, various operations are carried out under control of a microcomputer including a microprocessor unit (CPU) 1, a read-only memory (ROM) 2 and a random access memory (RAM) 3. The CPU 1 controls behavior of the entire electronic musical instrument. To the CPU 1 are connected, via a communication bus (e.g., data and address bus) 1D, the ROM 2, RAM 3, external storage device 4, performance operator unit 5, panel operator unit 6, display device 7, tone generator 8 and interface 9. Also connected to the CPU 1 is a timer 1A for counting various times, for example, to signal interrupt timing for timer interrupt processes. Namely, the timer 1A generates tempo clock pulses for counting a time interval or setting a performance tempo with which to automatically perform a music piece in accordance with given music piece data. The frequency of the tempo clock pulses is adjustable, for example, via a tempo-setting switch of the panel operator unit 6. Such tempo clock pulses generated by the timer 1A are given to the CPU 1 as processing timing instructions or as interrupt instructions. The CPU 1 carries out various processes in accordance with such instructions.

The ROM 2 stores therein various programs to be executed by the CPU 1 and also stores therein, as a waveform memory, various data, such as waveform data (indicative of, for example, waveforms having tone color variation based on a legato rendition style and the like, waveforms having straight tone colors, etc.). The RAM 3 is used as a working memory for temporarily storing various data generated as the CPU 1 executes predetermined programs, and as a memory for storing a currently-executed program and data related to the currently-executed program. Predetermined address regions of the RAM 3 are allocated to various functions and used as various registers, flags, tables, memories, etc. The external storage device 4 is provided for storing various data, such as performance information to be used as bases of automatic performances and waveform data corresponding to rendition styles, and various control programs, such as a "joint selection process" (see FIG. 4), to be executed or referred to by the CPU 1. Where a particular control program is not prestored in the ROM 2, the control program may be prestored in the external storage device (e.g., hard disk device) 4, so that, by reading the control program from the external storage device 4 into the RAM 3, the CPU 1 is allowed to operate in exactly the same way as in the case where the particular control program is stored in the ROM 2. This arrangement greatly facilitates version upgrade of the control program, addition of a new control program, etc. The external storage device 4 may comprise any of various removable-type external recording media other than the hard disk (HD), such as a flexible disk (FD), compact disk (CD-ROM or CD-RAM), magneto-optical disk (MO) and digital versatile disk (DVD). Alternatively, the external storage device 4 may comprise a semiconductor memory.

The performance operator unit 5 is, for example, in the form of a keyboard including a plurality of keys operable to select pitches of tones to be generated and key switches provided in corresponding relation to the keys. This performance operator unit 5 can be used not only for a manual tone performance based on manual playing operation by a human player, but also as input means for selecting desired prestored performance information to be automatically performed. It should be obvious that the performance operator unit 5 may be other than the keyboard type, such as a neck-like operator unit having tone-pitch-selecting strings provided thereon. The panel operator unit 6 includes various operators, such as performance information selecting switches for selecting desired performance information to be automatically performed and setting switches for setting various performance parameters, such as a tone color and effect, to be used for a performance. Needless to say, the panel operator unit 6 may also include a numeric keypad for inputting numerical value data to be used for selecting, setting and controlling tone pitches, colors, effects, etc. to be used for a performance, a keyboard for inputting text or character data, a mouse for operating a pointer to designate a desired position on any of various screens displayed on the display device 7, and various other operators. For example, the display device 7 comprises a liquid crystal display (LCD), CRT (Cathode Ray Tube) and/or the like, which visually displays not only various screens in response to operation of the corresponding switches but also various information, such as performance information and waveform data, and controlling states of the CPU 1. The human player can readily set various performance parameters to be used for a performance and select a music piece to be automatically performed, with reference to the various information displayed on the display device 7.

The tone generator 8, which is capable of simultaneously generating tone signals in a plurality of tone generation channels, receives performance information supplied via the communication bus 1D and synthesizes tones and generates tone signals on the basis of the received performance information. Namely, as waveform data corresponding to dynamics information included in performance information are read out from the ROM 2 or external storage device 4, the read-out waveform data are delivered via the bus 1D to the tone generator 8 and buffered as necessary. Then, the tone generator 8 outputs the buffered waveform data at a predetermined output sampling frequency. Tone signals generated by the tone generator 8 are subjected to predetermined digital processing performed by a not-shown effect circuit (e.g., DSP (Digital Signal Processor)), and the tone signals having undergone the digital processing are then supplied to a sound system 8A for audible reproduction or sounding.

The interface 9, which is, for example, a MIDI interface or communication interface, is provided for communicating various information between the electronic musical instrument and external performance information generating equipment (not shown). The MIDI interface functions to input performance information of the MIDI standard from the external performance information generating equipment (in this case, other MIDI equipment or the like) to the electronic musical instrument or output performance information of the MIDI standard from the electronic musical instrument to other MIDI equipment or the like. The other MIDI equipment may be of any desired type (or operating type), such as the keyboard type, guitar type, wind instrument type, percussion instrument type or gesture type, as long as it can generate data of the MIDI format in response to operation by a user of the equipment. The communication interface is connected to a wired or wireless communication network (not shown), such as a LAN, Internet, telephone line network, via which the communication interface is connected to the external performance information generating equipment (e.g., server computer). Thus, the communication interface functions to input various information, such as a control program and performance information, from the server computer to the electronic musical instrument. Namely, the communication interface is used to download particular information, such as a particular control program or performance information, from the server computer in a case where such particular information is not stored in the ROM 2, external storage device 4 or the like. In such a case, the electronic musical instrument, which is a "client", sends a command to request the server computer to download the particular information, such as a particular control program or performance information, by way of the communication interface and communication network. In response to the command from the client, the server computer delivers the requested information to the electronic musical instrument via the communication network. The electronic musical instrument receives the particular information via the communication interface and accumulatively stores it into the external storage device 4 or the like. In this way, the necessary downloading of the particular information is completed.

Note that where the interface 9 is in the form of a MIDI interface, the MIDI interface may be implemented by a general-purpose interface rather than a dedicated MIDI interface, such as RS232-C, USB (Universal Serial Bus) or IEEE1394, in which case other data than MIDI event data may be communicated at the same time. In the case where such a general-purpose interface as noted above is used as the MIDI interface, the other MIDI equipment connected with the electronic musical instrument may be designed to communicate other data than MIDI event data. Of course, the performance information handled in the present invention may be of any other data format than the MIDI format, in which case the MIDI interface and other MIDI equipment are constructed in conformity to the data format used.

Figure 2:
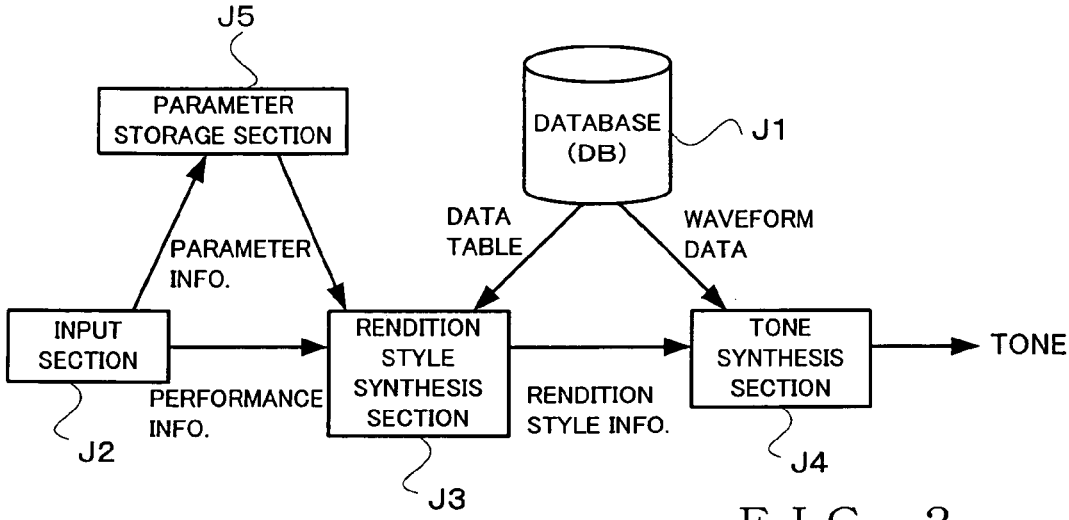
FIG. 2 is a functional block diagram explanatory of a tone synthesis function of the electronic musical instrument.

The electronic musical instrument shown in FIG. 1 is equipped with the tone synthesis function capable of successively generating tones on the basis of performance information generated in response to operation, by the human operator, of the performance operator unit 5 or performance information of the SMF (Standard MIDI File) or the like prepared in advance. Also, during execution of the tone synthesis function, the electronic musical instrument selects waveform data, which are to be newly used for various tone portions, on the basis of performance information supplied in accordance with a performance progression based on operation, by the human operator, of the performance operator unit 5 or performance information pre-read and supplied sequentially from a sequencer (not shown) or the like, and then it synthesizes a tone in accordance with the selected waveform data. So, the following paragraphs outline the tone synthesis function of the electronic musical instrument shown in FIG. 1, with reference to FIG. 2. FIG. 2 is a functional block diagram explanatory of the tone synthesis function of the electronic musical instrument, where arrows indicate flows of data.

Once the execution of the tone synthesis function is started, performance information is sequentially supplied from an input section J2 to a rendition style synthesis section J3. The input section J2 includes the performance operator unit 5 that generates performance information in response to performance operation by the human operator, and the sequencer (not shown) that supplies, in accordance with a performance progression, performance information prestored in the ROM 2 or the like. The performance information supplied from the input section J2 includes at least performance event data, such as note-on information and note-off information (these information will hereinafter be generically referred to as "note information"), and control data, such as dynamic information and pitch information. Upon receipt of the performance event data, control data, etc., the rendition style synthesis section J3 generates "rendition style information", including various information necessary for tone synthesis, by, for example, identifying an attack portion and joint portion on the basis of the note-on information, identifying a release portion on the basis of the note-off information and converting the received control data. More specifically, the rendition style synthesis section J3 refers to a data table, provided in a database J1 (waveform memory), etc. to select to-be-applied rendition style modules corresponding to input dynamics information and pitch information and then adds, to the "rendition style information", information indicative of the selected rendition style modules. When selecting a joint rendition style module to be applied to a joint portion, the rendition style synthesis section J3 refers to parameter information stored in a parameter storage section J5 and selects either a normal joint rendition style module or a latency-reducing joint rendition style module (see FIG. 3) in accordance with the referred-to parameter information. The parameter information stored in the parameter storage section J5 includes selection information for making selections as to which one of normal and latency-reducing joint rendition style modules is to be applied to the joint portion, which of tone quality and latency reduction should be emphasized, etc. Such parameter information may be either set by the user using the input section J2, or stored in memory in advance. Tone synthesis section J4 reads out, on the basis of the "rendition style information" generated by the rendition style synthesis section J3, waveform data to be applied from the database J1 and then performs tone synthesis on the basis of the read-out waveform data, so as to output a tone. Namely, the tone synthesis section J4 performs tone synthesis while appropriately switching between sets of waveform data in accordance with the "rendition style information".

Figure 3:
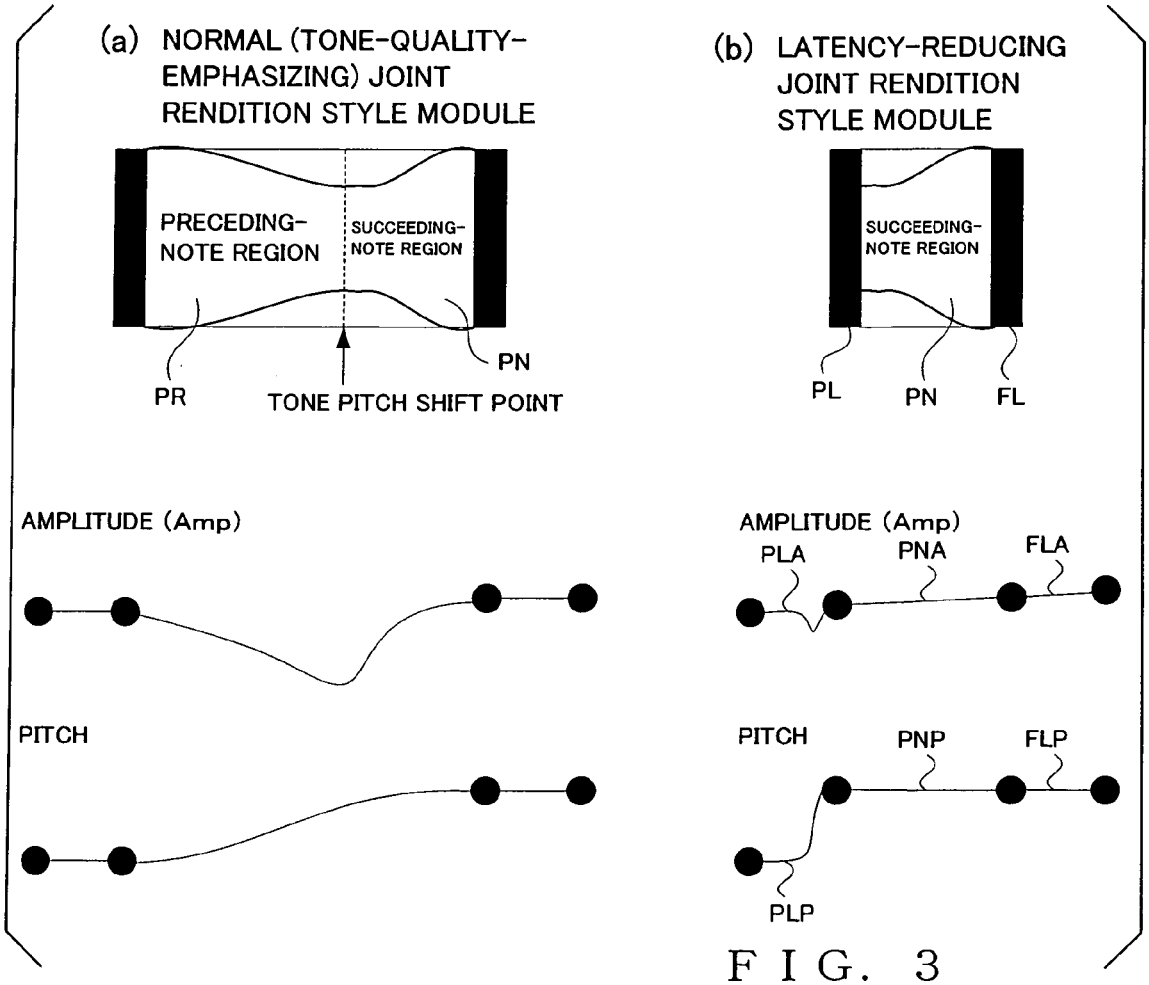
FIG. 3 is a conceptual diagram showing examples of joint rendition style modules used in the tone synthesis apparatus.

Next, with reference to FIG. 3, a description will be given about joint rendition style modules which are stored in the above-mentioned database J1 (waveform memory) and which are to be applied to waveform connecting portions. FIG. 3 is a conceptual diagram showing examples of joint rendition style modules. In FIG. 3, there are shown only envelopes of waveforms represented by rendition style waveform data and examples of trains of values at representative point (or representative point value trains) (indicated by black circular dots in the figure) of harmonic component amplitude (Amp) vectors and harmonic component pitch (Pitch) vectors, of "rendition style modules" each of which is a unit rendition style waveform processable as a single event in a rendition style waveform synthesis system; the "rendition style modules" are a multiplicity of sets of original waveform data and related data (hereinafter referred to as rendition style parameters) for reproducing waveforms corresponding to various rendition styles for various musical instruments.

In the present invention, the joint rendition style modules are prestored in the waveform memory in the following two major groups.

1) "Normal (tone-quality-emphasizing) joint rendition style modules": Each normal joint rendition style module is a conventionally-known joint rendition style module representative of (or covering) a waveform connecting portion for continuously connecting between two successive notes with no break (i.e., for making a continuous shift or transition from one note to the other with no intervening silent state), i.e. representative of a joint portion for continuously connecting between two successive notes using a legato rendition style or the like. Each normal joint rendition style module comprises a set of normal connecting waveform data which includes: a preceding-note section PR comprising a characteristic non-loop waveform representative of a transition of the preceding note (i.e., waveform preceding a tone pitch shift point); and a succeeding-note region PN comprising a characteristic non-loop waveform representative of a transition of the succeeding note (i.e., waveform following the tone pitch shift point). Each normal joint rendition style module also includes loop waveforms at its leading and trailing ends for crossfade-connection with other sets of waveform data. Each normal joint rendition style module further includes, in addition to the waveform data, amplitude and pitch information that is provided, at positions preceding the leading-end or front loop waveform, for controlling the preceding note, and amplitude and pitch information that is provided, at positions following the trailing-end or rear loop waveform, for controlling the succeeding note. In (a) of FIG. 3, there is shown an example of such a normal (tone-quality-emphasizing) joint rendition style module.

2) "Latency-reducing joint rendition style modules": Each latency-reducing joint rendition style module is a rendition style module representative of (or covering) a waveform connecting portion for continuously connecting between two successive notes with no break (i.e., for making a continuous shift from one note to the other with no intervening silent state), i.e. representative of a joint portion for continuously connecting between two successive notes using a legato rendition style. Each latency-reducing joint rendition style module comprises a set of waveform data which contains only a waveform of a succeeding-note section PN (i.e., waveform following a tone pitch shift point) without containing a waveform of a preceding-note region, unlike the above-discussed normal joint rendition style module. For example, each latency-reducing joint rendition style module employed in the instant embodiment is created by segmenting the waveform data of the aforementioned normal joint rendition style module into a plurality of waveform data regions on the basis of waveform characteristics of the waveform data (primarily, the shift point from the tone pitch of the preceding note to the tone pitch of the succeeding note) and setting only characteristic waveform data of one of the segmented regions (e.g., waveform data of the region following the tone pitch shift point) as rendition style waveform data (i.e., "special connecting waveform data") dedicated to latency reduction. Needless to say, each latency-reducing joint rendition style module includes loop waveforms at its leading and trailing ends (i.e., front loop waveform PL and rear loop waveform FL), in a similar manner to the normal joint rendition style module.

Note that amplitude (Amp) and pitch vectors in each "latency joint rendition style module" comprise portions PLA and PLP corresponding to the front loop waveform PL, portions PNA and PNP corresponding to the non-loop waveform PN, and portions FLA and FLP corresponding to the rear loop waveform FL. Namely, an amplitude envelope and pitch envelope are generated on the basis of the amplitude vector PLA and pitch vector PLP corresponding to the front loop waveform PL, the front loop waveform PL is repetitively generated in correspondence with the amplitude and pitch envelopes and subjected to amplitude and pitch control, and the generated loop waveform PL is crossfade-connected (i.e., connected in a crossfading fashion) with the waveform of the preceding note having so far been sounded. Then, an amplitude envelope and pitch envelope are generated on the basis of the amplitude vector PNA and pitch vector PNP corresponding to the non-loop waveform PN, the non-loop waveform PN is generated in correspondence with the amplitude and pitch envelopes and subjected to amplitude and pitch control. Then, an amplitude envelop and pitch envelope are generated of the basis of the amplitude vector FLA and pitch vector FLP corresponding to the rear loop waveform FL, the rear loop waveform FL is repetitively generated and subjected to amplitude and pitch control, and the rear loop waveform FL is crossfade-connected with the waveform to be audibly generated or sounded later than the rear loop waveform.

The above-described classification is just an illustrative example, and rendition styles may be classified per player, type of musical instrument, performance genre and/or other original tone source.

As known in the art, each set of rendition style waveform data corresponding to one rendition style module is prestored in the database as a collection of a plurality of waveform-constituting elements rather than the complete set of rendition style waveform data being prestored in the database as originally input. Each of the waveform-constituting elements will hereinafter be called a "vector". As an example, each rendition style module may include the following vectors.

1) Waveform shape (Timbre) vector of the harmonic component: This vector represents only a characteristic of a waveform shape extracted from among the various waveform-constituting elements of the harmonic component and normalized in pitch and amplitude.

2) Amplitude vector of the harmonic component: This vector represents a characteristic of an amplitude envelope extracted from among the waveform-constituting elements of the harmonic component.

3) Pitch vector of the harmonic component: This vector represents a characteristic of a pitch extracted from among the waveform-constituting elements of the harmonic component; for example, it represents a characteristic of timewise pitch fluctuation relative to a given reference pitch.

4) Waveform shape (Timbre) vector of the nonharmonic component: This vector represents only a characteristic of a waveform shape (noise-like waveform shape) extracted from among the waveform-constituting elements of the nonharmonic component and normalized in amplitude.

5) Amplitude vector of the nonharmonic component: This vector represents a characteristic of an amplitude envelope extracted from among the waveform-constituting elements of the nonharmonic component.

The rendition style waveform data of each rendition style module may include one or more other types of vectors, such as a time vector indicative of a time-axial progression of the waveform, although not specifically described here. Note that the "harmonic" and "nonharmonic" components are defined here by separating an original rendition style waveform in question into a waveform segment having a pitch-harmonious component and the remaining waveform segment having a non-pitch-harmonious component.

For synthesis of a rendition style waveform, waveforms or envelopes corresponding to various constituent elements of the rendition style waveform are constructed along a reproduction time axis of a performance tone by applying appropriate processing to these vector data in accordance with control data and arranging or allotting the thus-processed vector data on or to the time axis and then carrying out a predetermined waveform synthesis process on the basis of the vector data allotted to the time axis. For example, in order to produce a desired performance tone waveform, i.e. a desired rendition style waveform exhibiting predetermined ultimate rendition style characteristics, a waveform segment of the harmonic component is produced by imparting a harmonic component's waveform shape vector with a pitch and time variation characteristic thereof corresponding to a harmonic component's pitch vector and an amplitude and time variation characteristic thereof corresponding to a harmonic component's amplitude vector, and a waveform segment of the nonharmonic component is produced by imparting a nonharmonic component's waveform shape vector with an amplitude and time variation characteristic thereof corresponding to a nonharmonic component's amplitude vector. Then, the desired performance tone waveform can be produced by additively synthesizing the thus-produced harmonic and nonharmonic components' waveform segments.

Examples of data (rendition style parameters) additionally stored in the above-mentioned database J1 along with various sets of waveform data include dynamics values and pitch information of the original waveform data and basic crossfade time lengths to be used for waveform synthesis. Group of such data (rendition style parameters) can be collectively managed as a "data table". Namely, the rendition style parameters for each rendition style module are intended to control the time length, level, etc. of the waveform pertaining to the rendition style module and may include one or more kinds of parameters depending on the nature of the rendition style module. These rendition style parameters may be prestored in the waveform memory or the like, or may be entered by user's input operation. Existing rendition style parameters may be modified as desired via user operation. Further, in a situation where no rendition style parameter has been gen at the time of reproduction of a rendition style waveform, standard rendition style parameters may be automatically imparted. Furthermore, suitable parameters may be automatically produced and imparted in the course of processing.

Next, with primary reference to FIG. 4, a detailed description will be given about the "joint selection process" for selecting any one of the joint rendition style modules (see FIG. 3), stored in the database J1, for tone synthesis in a waveform connecting or joint portion. FIG. 4 is a flow chart showing an example operational sequence of the "joint selection process". The "joint selection process" is performed by the rendition style synthesis section J3 when it has been determined, on the basis of performance information input in response to operation by the human player in not-shown "performance tone syntheses processing", that a legate rendition style is to be used in a waveform connecting portion, i.e. a joint rendition style module is to be applied to the tone connecting portion. Namely, waveforms of an attack portion and body portion of a preceding note have already been generated through the not-shown "performance tone syntheses processing" prior to the execution of the "joint selection process", and when it has been determined, following the performance tone syntheses processing of the attack portion and body portion of the preceding note, that a joint rendition style module is to be applied, the "joint selection process" is performed, in which a joint rendition style module to be used for waveform synthesis of the joint portion is selected so that a continuous tone waveform can be generated on the basis of the selected joint rendition style module.

At step S1, a selection is made as to which one of the conventional normal joint rendition style module having both a preceding-note region and a succeeding-note region and the latency-reducing joint rendition style module having only a succeeding-note region (without having a preceding-note region), is to be used for generation of tone waveform data. In this "joint selection process", any one of the normal and latency-reducing joint rendition style modules may be selected in accordance with parameter information preset, for example, by the user to instruct on which of the latency reduction and tone quality an emphasis should be put, or by automatically determining whether the performance in question is a real-time performance or a playback performance. In the case where the emphasis should be put on the latency reduction or in the case of a real-time performance, any one of latency-reducing joint rendition style modules may be selected, but, in the case where the emphasis should be put on the tone quality or in the case of a playback performance, any one of normal joint rendition style modules may be selected. If any one of the normal joint rendition style modules has been selected (NO determination at step S1), rendition style information, instructing that the normal joint rendition style module be used, is generated (step S6), in which case the latency is of course not reduced (see FIG. 5).

If, on the other hand, any one the latency-reducing joint rendition style modules has been selected (YES determination at step S1), a determination is made, at step S2, as to whether the crossfade (time) length stored in the database J1 is to be adjusted or not. If the crossfade (time) length is not to be adjusted as determined at step S2 (NO determination at step S2), rendition style information, instructing that the selected latency-reducing joint rendition style module be used with the original crossfade length (i.e., crossfade length indicated by the original waveform data of the module) stored in the database J1, is generated at step S5. If the crossfade length is to be adjusted (YES determination at step S2), respective allotted time points of the amplitude, pitch, waveform shape vectors are processed, at step S3, in accordance with designated percentages etc. For example, the electronic musical instrument includes a switch for turning on/off a crossfade length adjustment function, and if the crossfade length adjustment function has been set at "ON" (i.e., where a setting has been made to instruct that the crossfade length be adjusted), the crossfade length adjustment function may be arranged in advance to follow a predetermined rule such that the original crossfade length be automatically reduced to a predetermined length, such as 50% of the original time length, or the user may be allowed to set as desired, per note, information indicating by what percentage the original crossfade length is to be reduced. Then, rendition style information, instructing that the selected latency-reducing joint rendition style module be used with the processed crossfade length, is generated at step S4. Namely, according to the "joint selection process" performed in the instant embodiment, any one of the normal and latency-reducing joint rendition style modules can be selected as the joint rendition style module to be used for tone synthesis corresponding to the waveform connecting portion (or joint portion), and, if any one of the latency-reducing joint rendition style modules has been selected, the length of crossfade with the body portion of the preceding note can be adjusted. In this way, it is possible to reduce an undesired auditory tone generating delay (latency), in the connecting or joint portion, of the succeeding note.

Figure 5:
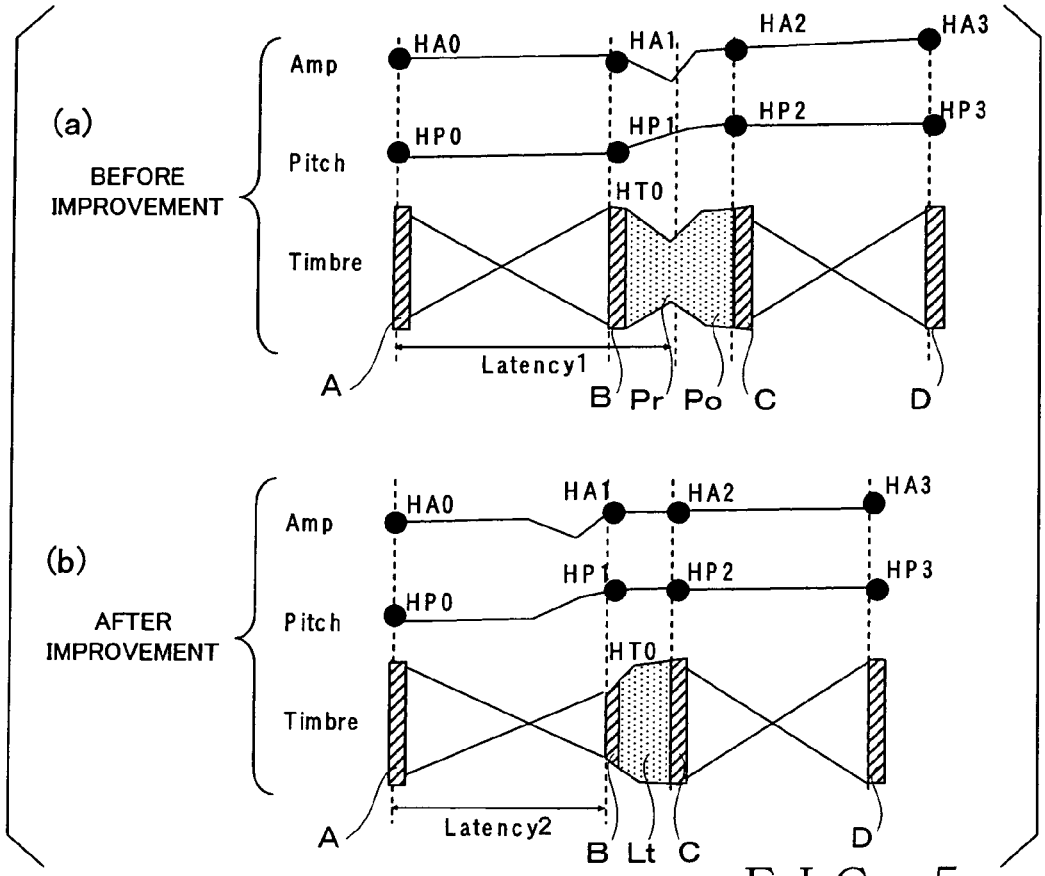
FIG. 5 is a diagram explanatory of auditory tone generating delays (latencies) in a case where a normal joint rendition style is used and in a case where a module latency-reducing joint rendition style module is used.

Now, with reference to FIG. 5, a comparative description will be given about auditory tone generating delays (latencies), in note (waveform) connecting portions (or joint portions), of succeeding notes in a case where a normal joint rendition style module is used and in a case where a latency-reducing joint rendition style module is used. More specifically, (a) of FIG. 5 is explanatory of a latency in the case where tone synthesis is performed using a normal joint rendition style module (i.e., "latency before latency improvement"), while (b) of FIG. 5 is explanatory of a latency in the case where a latency-reducing joint rendition style module is used (i.e., "latency after latency improvement"). Note that, in FIG. 5, there are shown examples of individual vectors of the harmonic component in the joint rendition style module with illustration of individual vectors of the nonharmonic component omitted. In each of (a) and (b) of the figure, "HA" represents an example train of values at representative points (i.e., "0", "1", "2" and "3" at four representative points) of the amplitude vector of the harmonic component, and "HT" represents an example of the waveform shape (Timbre) vector of the harmonic component (here, the waveform shape is represented by its envelope alone).

In the case where a normal joint rendition style module is to be used and once performance information is acquired, one normal joint rendition style module is selected from the database, and rendition style information is generated. Then, the waveform data of the selected normal joint rendition style module are read out on the basis of the generated rendition style information, to thereby generate a tone waveform of the connecting portion. At that time, a crossfade (connection) is carried out between the last loop waveform A of the body portion of the preceding note and the loop waveform B of the normal joint rendition style module, to synthesize a tone. When a time corresponding to the crossfade length has elapsed, the waveform data of the preceding-note region Pr of the normal joint rendition style module are read out to generate a tone waveform of the preceding-note region of the connecting portion. After the entire tone waveform of the preceding-note region has been fully generated, the waveform data of the succeeding-note region Po of the normal joint rendition style module are read out to generate a tone waveform of the succeeding-note region following the preceding-note region. Once all of the waveform data of the succeeding-note region Po are read out, a crossfade (connection) is carried out between the loop waveform C of the normal joint rendition style module and the first loop waveform D of the release portion (or body portion) of the succeeding note. In this case, a time corresponding to "Latency 1" is required before the readout of the succeeding-note region Po of the normal joint rendition style module is started.

In the case where a latency-reducing joint rendition style module is to be used, on the other hand, and once performance information is acquired, one latency-reducing joint rendition style module is selected from the database, and rendition style information is generated. Then, the waveform data of the selected latency-reducing joint rendition style module are read out on the basis of the generated rendition style information, to thereby generate a tone waveform of the connecting portion. At that time, a crossfade is carried out between the last loop waveform A of the body portion of the preceding note and the loop waveform B of the latency-reducing joint rendition style module, to synthesize a tone. When a time corresponding to the crossfade length has elapsed, the waveform data Lt of the latency-reducing joint rendition style module are read out to generate a tone waveform of the entire connecting portion. After all of the waveform data Lt of the latency-reducing joint rendition style module have been read out, a crossfade is carried out between the loop waveform C of the latency-reducing joint rendition style module and the first loop waveform D of the release portion (or body portion) of the succeeding note. Namely, in the case where the latency-reducing joint rendition style module is used, the loop waveform A of the body portion of the preceding note and the waveform data Lt of the latency-reducing joint rendition style module, which corresponds to the succeeding-note region Po, are directly crossfade-connected, to generate a tone. In this case, a time corresponding to "Latency 2" is required before the readout of the waveform data Lt of the latency-reducing joint rendition style module is started. Latency 2 is shorter in time length than Latency 1, and thus, the instant embodiment can reduce the tone generating delay (latency) of the succeeding note as compared to the conventionally-known technique.

In the case where the normal joint rendition style module is used, as set forth above, the readout of the waveform data Po of the succeeding-note region is started only after all of the waveform data Pr of the preceding-note region have been read out, and thus, a considerable tone generating delay (latency) would be unavoidably produced for the succeeding note due to the influence of the time length of the preceding-note region. In the case where the latency-reducing joint rendition style module is used, on the other hand, the readout of the waveform data Lt of the succeeding-note region is started immediately after completion of the crossfade between the loop waveforms (A and B) because the waveform data Lt include no preceding-note region as included in the normal joint rendition style module. Thus, the succeeding note can be prevented from being influenced by the preceding-note region Pr unlike in the conventionally-known technique, so that the undesired latency can be significantly reduced. Further, in the case where the latency-reducing joint rendition style module is used to synthesize a tone, the crossfade, carried out between the last loop waveform A of the body portion of the preceding note and the loop waveform B of the latency-reducing joint rendition style module as set forth above, can also reliably eliminate influences of the preceding-note region Po.

Figure 6:
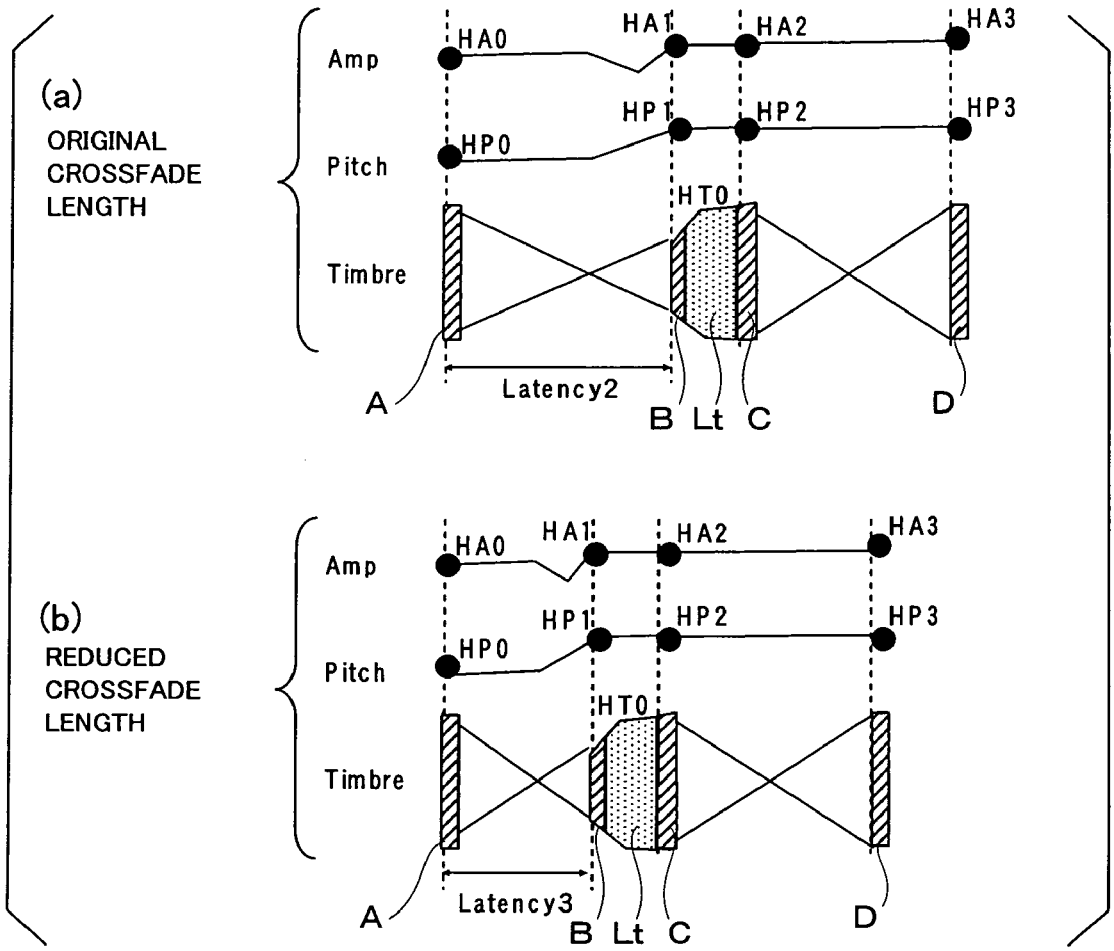
FIG. 6 is a diagram explanatory of auditory tone generating delays (latencies) in a case where tone synthesis is performed without a crossfade length being adjusted and in a case where tone synthesis is performed with the crossfade length adjusted.

As described above, the instant embodiment of the present invention can significantly reduce the undesired latency, as compared to the conventionally-known technique, by using the latency-reducing joint rendition style module to synthesize a tone. However, in the case where the latency-reducing joint rendition style module is used, the transition from the preceding note to the succeeding note may undesirably become abrupt as compared to the case where the normal joint rendition style module is used. To avoid such an inconvenience, the above-described "joint selection process" is arranged to permit tone synthesis with the crossfade length adjusted as desired (see step S2 in FIG. 4). Thus, now, a comparative description will be given, with reference to FIG. 6, about auditory tone generating delays (latencies) in note (waveform) connecting portions in a case where tone synthesis is performed without the crossfade length being adjusted and in a case where tone synthesis is performed with the crossfade length adjusted. More specifically, (a) of FIG. 6 is explanatory of the latency in the case where the tone synthesis is performed with the original (i.e., unadjusted) crossfade length, while (b) of FIG. 6 is explanatory of the latency in the case where the tone synthesis is performed with the crossfade length adjusted. FIG. 6 shows examples of individual vectors of the harmonic component in the joint rendition style module in a similar manner to FIG. 5, and reference characters "HA", "HP", "HT", etc. in FIG. 6 represent the same as in FIG. 5.

As seen from FIG. 6, in the case where the crossfade length is adjusted, a time length between "HA0" and "HA1" is adjusted for the amplitude vector, a time length between "HP0" and "HP1" is adjusted for the pitch vector, and a time of "HT0" is adjusted for the waveform shape (Timbre) vector. In the case where the original crossfade length is used without being adjusted, and if the time length between "HA0" and "HA1" of the amplitude vector and the time length between "HP0" and "HP1" of the pitch vector are used as originally defined, the original crossfade length can be secured for the crossfade between the waveform A of the body portion of the preceding note and the loop waveform B of the latency-reducing joint rendition style module and thus a tone transition from the body section can be made smooth. In the case where the crossfade length is reduced, on the other hand, and if the time length between "HA0" and "HA1" of the amplitude vector and the time length between "HP0" and "HP1" of the pitch vector are reduced, the length of the crossfade between the waveform A of the body portion of the preceding note and the loop waveform B of the latency-reducing joint rendition style module can be reduced (i.e., made shorter), so that the latency can be reduced (see Latency 2 and Latency 3) although a tone transition from the body section can not be made smooth unlike in a case where the crossfade length is increased (i.e., made longer).

Figure 7:
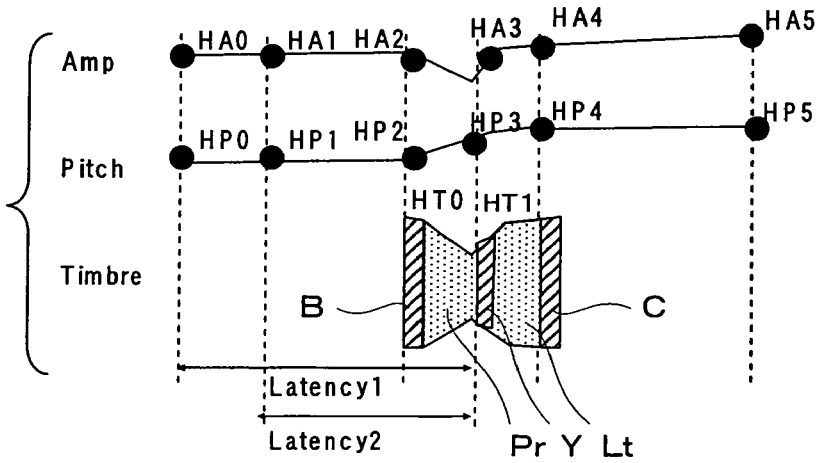
FIG. 7 is a diagram showing a normal joint rendition style module with a latency-reducing joint rendition style module added thereto.
Figure 8:
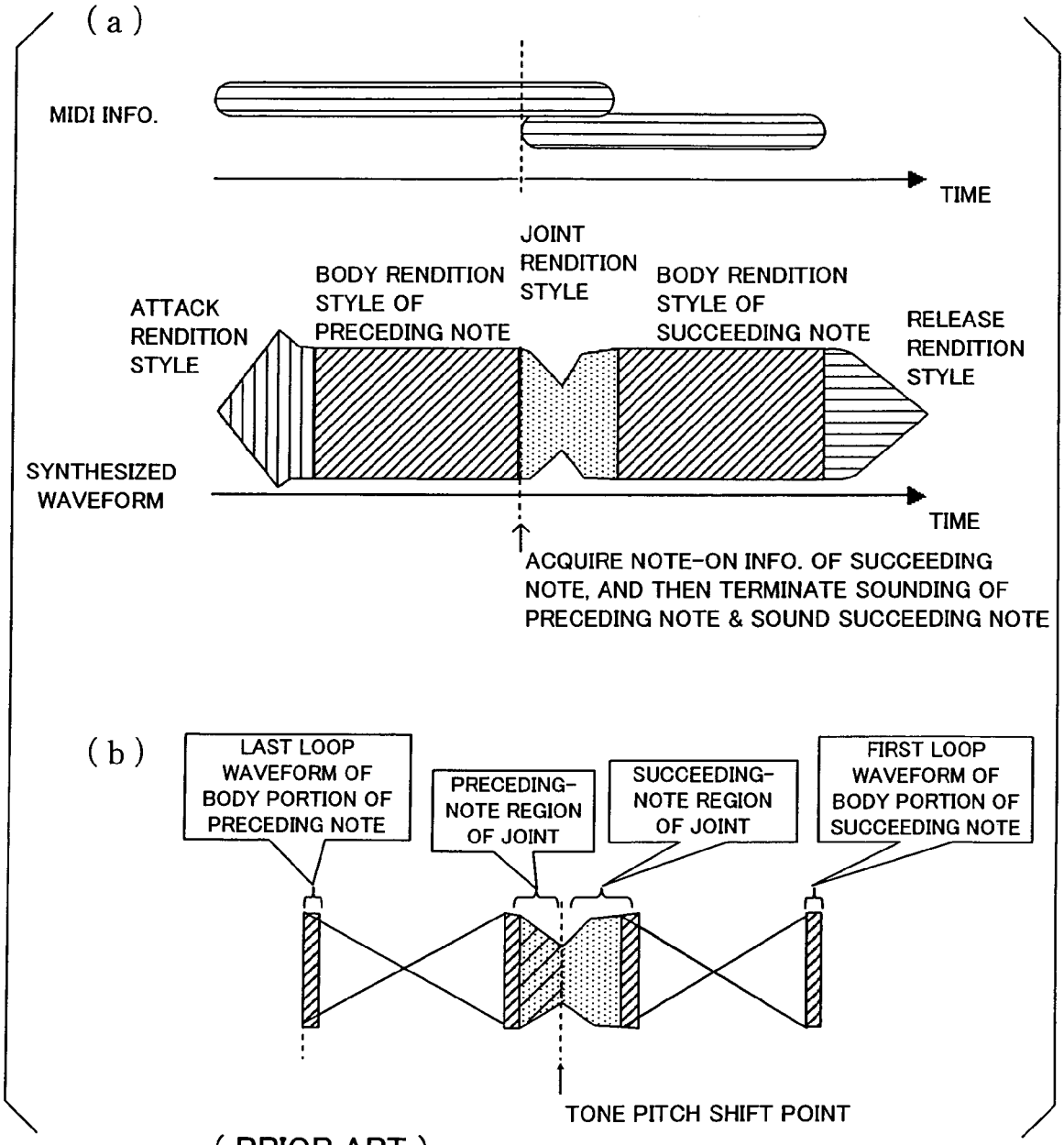
(PRIOR ART) FIG. 8
FIG. 8 is a schematic diagram showing an example of a conventionally-known joint rendition style module.

Whereas the embodiment has been described above in relation to the case where the normal and latency-reducing joint rendition style modules are prepared separately, the present invention is not so limited. For example, as illustrated in FIG. 7, a conventional normal joint rendition style module may have a latency-reducing joint rendition style module added thereto so that the single joint rendition style module can be used for two purposes by switching between the normal purpose and the latency-reducing purpose as necessary. In such a case, a train of values at representative points (i.e., HA0-HA5) of the amplitude vector, a train of values at representative points (i.e., HP0-HP5) of the pitch vector and waveform shape vectors (HT0 and HT1) are stored in the data table as vector information, as shown in FIG. 7, and waveforms a preceding-note region Pr, succeeding-note region Lt, front and rear loop waveforms B and C, a loop waveform Y between the preceding-note region Pr and the succeeding-note region Lt, etc. are stored in the waveform memory. When a switching is to be made, of the single joint rendition style module, from the normal purpose to the latency-reducing purpose, it is only necessary that four points, "HA1", "HA3", "HA4" and "HA5", of the representative point value train of the amplitude vector, four points, "HP1", "HP3", "HP4" and "HP5", of the representative point value train of the pitch vector and "HT1" of the waveform shape vector be given as vector data. When, on the other hand, a switching is to be made, of the single joint rendition style module, from the latency-reducing purpose to the normal purpose, it is only necessary that four points, "HA0", "HA2", "HA4" and "HA5", of the representative point value train of the amplitude vector, four points, "HP0", "HP2", "HP4" and "HP5", of the representative point value train of the pitch vector and "HT0" of the waveform shape vector be given as vector data.

It should also be appreciated that the waveform data employed in the present invention may be of any desired type without being limited to those constructed as rendition style modules in correspondence with various rendition styles as described above. Further, the waveform data of the individual units may of course be either data that can be generated by merely reading out waveform sample data based on a suitable coding scheme, such as the PCM, DPCM or ADPCM, or data generated using any one of the various conventionally-known tone waveform synthesis methods, such as the harmonics synthesis operation, FM operation, AM operation, filter operation, formant synthesis operation and physical model tone generator methods. Namely, the tone generator 8 in the present invention may employ any of the known tone signal generation methods such as: the memory readout method where tone waveform sample value data stored in a waveform memory are sequentially read out in accordance with address data varying in response to the pitch of a tone to be generated; the FM method where tone waveform sample value data are acquired by performing predetermined frequency modulation operations using the above-mentioned address data as phase angle parameter data; and the AM method where tone waveform sample value data are acquired by performing predetermined amplitude modulation operations using the above-mentioned address data as phase angle parameter data. Namely, the tone signal generation method employed in the tone generator 8 may be any one of the waveform memory method, FM method, physical model method, harmonics synthesis method, formant synthesis method, analog synthesizer method using a combination of VCO, VCF and VCA, analog simulation method, and the like. Further, instead of constructing the tone generator 8 using dedicated hardware, the tone generator circuitry 8 may be constructed using a combination of the DSP and microprograms or a combination of the CPU and software. Furthermore, a plurality of tone generation channels may be implemented either by using a single circuit on a time-divisional basis or by providing a separate dedicated circuit for each of the channels.

Further, the tone synthesis method in the above-described tone synthesis processing may be either the so-called playback method where existing performance information is acquired in advance prior to arrival of original performance timing and a tone is synthesized by analyzing the thus-acquired performance information, or the real-time method where a tone is synthesized on the basis of performance information supplied in real time.

Further, the method employed in the present invention for connecting together waveforms of a plurality of units sequentially selected and generated in a time-serial manner is not limited to the crossfade synthesis and may, for example, be a method where waveforms of generated units are mixed together via a fader means.

Note that the aforementioned crossfade may be performed, in the instant embodiment, along a suitable curved crossfading curve rather than a linear crossfading curve.

Furthermore, in the case where the above-described tone synthesis apparatus of the present invention is applied to an electronic musical instrument, the electronic musical instrument may be of any type other than the keyboard instrument type, such as a stringed, wind or percussion instrument type. The present invention is of course applicable not only to the type of electronic musical instrument where all of the performance operator unit, display, tone generator, etc. are incorporated together within the body of the electronic musical instrument, but also to another type of electronic musical instrument where the above-mentioned components are provided separately and interconnected via communication facilities such as a MIDI interface, various networks and/or the like. Further, the tone synthesis apparatus of the present invention may be implemented with a combination of a personal computer and application software, in which case various processing programs may be supplied to the tone synthesis apparatus from a storage medium, such as a magnetic disk, optical disk or semiconductor memory, or via a communication network. Furthermore, the tone synthesis apparatus of the present invention may be applied to automatic performance apparatus, such as karaoke apparatus and player pianos, game apparatus, and portable communication terminals, such as portable telephones. Further, in the case where the tone synthesis apparatus of the present invention is applied to a portable communication terminal, part of the functions of the portable communication terminal may be performed by a server computer so that the necessary functions can be performed cooperatively by the portable communication terminal and server computer. Namely, the tone synthesis apparatus of the present invention may be arranged in any desired manner as long as it can use predetermined software or hardware, arranged in accordance with the basic principles of the present invention, to synthesize a tone while appropriately switching between normal and latency-reducing joint rendition style modules stored in the database.

What is claimed is:

1. A tone synthesis apparatus comprising:

a storage section that stores connecting waveform data for connecting between at least two notes to be generated in succession, the stored connecting waveform data including normal connecting waveform data and special connecting waveform data for reducing a delay in tone generation timing of a succeeding note as compared to the normal connecting waveform data, wherein one of the normal connecting waveform data and the special connecting waveform data is selectively read out from the storage section, said normal connecting waveform data containing waveforms of both preceding-note and succeeding-note regions of a waveform connecting portion that is provided for a continuous transition between the at least two notes, and wherein the special connecting waveform data containing only the waveform of the succeeding-note region;

an acquisition section that acquires performance information in accordance with a progression of a select one of a real-time performance and playback performance; and a tone generation section that, when a connecting tone is to be generated for connecting between at least two successive notes in a legato style in accordance with the performance information acquired by said acquisition section, acquires the special connecting waveform data from the storage section if the performance information is based on the real-time performance, and acquires the normal connecting waveform data from the storage section if the performance information is based on the playback performance, said tone generation section generating a tone waveform connecting between waveforms of the at least two successive notes on the basis of the acquired connecting waveform data.

2. A tone synthesis apparatus as claimed in claim 1 wherein the special connecting waveform data stored in said storage section contain a non-loop waveform that comprises the waveform of the succeeding-note region and a front loop waveform preceding the non-loop waveform, and wherein, when the tone waveform is to be generated on the basis of the special connecting waveform data, said tone generation section performs crossfade synthesis between the front loop waveform of the special connecting waveform data and a loop waveform contained in waveform data of a preceding note that precedes the connecting portion and then generates the non-loop waveform that comprises the waveform of the succeeding-note region.

3. A tone synthesis apparatus as claimed in claim 2 wherein the special connecting waveform data stored in said storage section further contain a rear loop waveform following the non-loop waveform, and wherein, after generation of the non-loop waveform, said tone generation section performs crossfade synthesis between the rear loop waveform and a loop waveform contained in waveform data of a succeeding note that follows the connecting portion.

4. A tone synthesis apparatus as claimed in claim 2 wherein said tone generation section adjusts a time length over which the crossfade synthesis is to be performed, so as to reduce a delay in tone generation timing of the succeeding note.

5. A tone synthesis apparatus as claimed in claim 1 wherein the special connecting waveform data includes waveform data adapted to be connected with a succeeding note.

6. A method for synthesizing a tone using a storage section that stores connecting waveform data for connecting between at least two notes to be generated in succession, the stored connecting waveform data including normal connecting waveform data and special connecting waveform data for reducing a delay in tone generation timing of a succeeding note as compared to the normal connecting waveform data, wherein one of the normal connecting waveform data and the special connecting waveform data is selectively read out from the storage section, said normal connecting waveform data containing waveforms of both preceding-note and succeeding-note regions of a waveform connecting portion that is provided for a continuous transition between the at least two notes, and wherein the special connecting waveform data containing only the waveform of the succeeding-note region, said method comprising:

a step of acquiring performance information in accordance with a progression of a selected one of a real-time performance and playback performance; and a tone generation step of, when a connecting tone is to be generated for connecting between at least two successive notes in a legato style in accordance with the performance information acquired by said step of acquiring, acquiring the special connecting waveform data from the storage section if the performance information is based on the real-time performance, and acquiring the normal connecting waveform data from the storage section if the performance information is based on the playback performance, said tone generating step generating a tone waveform connecting between waveforms of the at least two successive notes on the basis of the acquired connecting waveform data.

7. A computer-readable storage medium containing a group of instructions for causing a computer to perform a tone synthesis procedure using a storage section that stores connecting waveform data for connecting between at least two notes to be generated in succession, the stored connecting waveform data including normal connecting waveform data and special connecting waveform data for reducing a delay in tone generation timing of a succeeding note as compared to the normal connecting waveform data, wherein one of the normal connecting waveform data and the special connecting waveform data is selectively read out from the storage section, said normal connecting waveform data containing waveforms of both preceding-note and succeeding-note regions of a waveform connecting portion that is provided for a continuous transition between the at least two notes, and wherein the special connecting waveform data containing only the waveform of the succeeding-note region, said tone synthesis procedure comprising:

a step of acquiring performance information in accordance with a progression of a selected one of a real-time performance and playback performance; and a tone generation step of, when a connecting tone is to be generated for connecting between at least two successive notes in a legato style in accordance with the performance information acquired by said step of acquiring, acquiring the special connecting waveform data from the storage section if the performance information is based on the real-time performance, and acquiring the normal connecting waveform data from the storage section if the performance information is based on the playback performance, said tone generating step generating a tone waveform connecting between waveforms of the at least two successive notes on the basis of the acquired connecting waveform data.

* * * * *